United States Patent [19]

Speil

[11] Patent Number: 4,745,889

[45] Date of Patent: May 24, 1988

[54] HYDRAULIC VALVE TAPPET

[75] Inventor: Walter Speil, Ingolstadt, Fed. Rep. of Germany

[73] Assignee: Motomak Motorenbau, Maschinen-und Werkzeugfabrik, Konstruktionen GmbH, Fed. Rep. of Germany

[21] Appl. No.: 880,805

[22] Filed: Jul. 1, 1986

[30] Foreign Application Priority Data

Aug. 8, 1985 [DE] Fed. Rep. of Germany ..... 3528432

[51] Int. Cl.[4] ..... F01L 1/24

[52] U.S. Cl. ..... 123/90.55

[58] Field of Search ..... 123/90.55–90.59

[56] References Cited

U.S. PATENT DOCUMENTS 4,465,038 8/1984 Speil ..... 123/90.55

FOREIGN PATENT DOCUMENTS 30781 6/1981 European Pat. Off. ..... 123/90.55

2758957 7/1979 Fed. Rep. of Germany ... 123/90.55

3437478 4/1986 Fed. Rep. of Germany ... 123/90.55

*Primary Examiner*—Tony M. Argenbright

*Attorney, Agent, or Firm*—Bierman and Muserlian

[57] ABSTRACT

A self-adjusting hydraulic valve tappet arranged in a guide bore of a cylinder head of an internal combustion engine and contacted at one end face by a control cam and abutting with a second end face against the end of a valve stem, the tappet consisting of a cup-shaped housing (1) comprising a hollow cylindrical wall (2) closed at one end by an end member (3) against the outside of which the cam abuts, and a cylindrical guide sleeve (6,28) concentric with the cylindrical wall (2), characterized in that the guide sleeve has at a point distant from the end member (3) an intake port (26,31,53) that opens into a duct extending to the end member (3), which is defined, on the one hand, by the outer surface of the outer piston (16) and, on the other hand, by the bore of the guide sleeve (6), and an oil transfer port (19,34) leading into the centric oil reservoir (18) is provided at the end of the inner piston (17) facing the end member (3).

5 Claims, 2 Drawing Sheets

HYDRAULIC VALVE TAPPET

STATE OF THE ART

Figure 1:
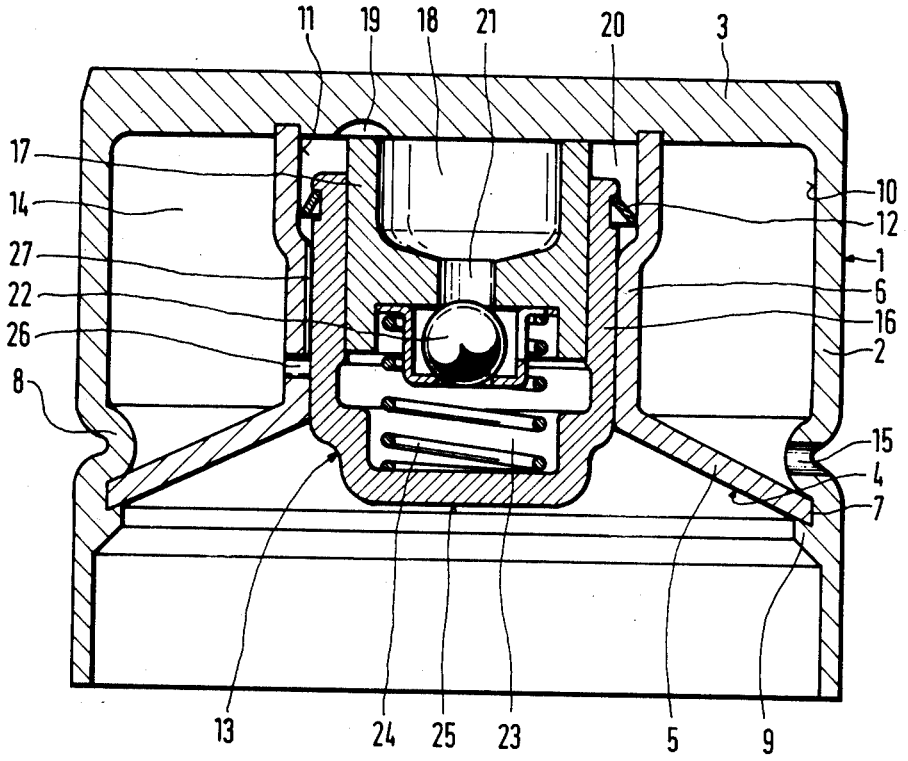

Self-adjusting hydraulic valve tappets arranged in a guide bore of a cylinder head of an internal combustion engine and contacted at one end face by a control cam and abutting with a second end face against the end of a valve stem, the tappet consisting of a cup-shaped housing (1) comprising a hollow cylindrical wall (2) closed at one end by an end member (3) against the outside of which the cam abuts, and a cylindrical guide sleeve (6,28) concentric with the cylindrical wall (2), said guide sleeve emanating from the end member (3) extends to the center of an annular flange element (5,29), which at its outer circumference merges into the cylindrical wall (2) of the housing (1) to define an annular oil reservoir (14) between the cylindrical wall (2) and the cylindrical guide sleeve (6,28), the oil reservoir being supplied with oil through a bore (15) leading to the outside of the housing, a self-adjusting hydraulic play compensating element (13) guided in the guide sleeve for slidable longitudinal movement and comprising an inner piston (17) and an outer piston (16) surrounding said inner piston, both pistons being guided for slidable longitudinal movement within each other to define an oil pressure chamber (23), which through a bore (21) closed by a check valve (22) in the inner piston (17) is connected to a centric oil reservoir (18) arranged in the inner piston (17), and defined, on the one hand, by the wall of the inner piston (17) and, on the other hand, by the inner surface (10) of the end member (3), against which the inner piston (17) abuts with its end face, the outer piston (16) being guided for slidable longitudinal movement in the cylindrical guide sleeve (6,28) with its closed end abutting against the end of the valve stem are known.

In such valve tappets, the oil transfer from the outer annular oil reservoir into the oil reservoir arranged concentrically in the inner piston at a point is adjacent to the bottom of the tappet. However, there are operating conditions under which the outer annular oil reservoir is only partially filled with oil, or at least contains a portion, even though a small amount, of air. If, when starting the engine, the oil present in the centric oil reservoir is needed to fill the high-pressure chamber, then the air present at the upper end of the outer annular oil reservoir is sucked into the centric oil reservoir. This air, now present in the centric oil reservoir cannot be again removed from it quickly enough, but rather also gets into the high-pressure oil chamber in the course of the next working clearances, which leads to the known disadvantageous consequences.

OBJECTS OF THE INVENTION

It is an object of the invention to provide a novel valve tappet by means of simple construction measures ensures that the air settling at the upper end of the outer annular oil reservoir cannot be sucked into the centric oil reservoir.

This and other objects and advantages of the invention will become obvious from the following detailed description.

THE INVENTION

The self-adjusting hydraulic valve tappet of the invention comprises a hydraulic valve tappet arranged in a guide bore of a cylinder head of an internal combustion engine and contacted at one end face by a contol cam and abutting with a second end face against the end of a valve stem, the tappet consisting of a cup-shaped housing (1) comprising a hollow cylindrical wall (2) closed at one end by an end member (3) against the outside of which the cam abuts, and a cylindrical guide sleeve (6,28) concentric with the cylindrical wall (2), said guide sleeve emanating from the end member (3) extends to the center of an annular flange element (5,29), which at its outer circumference merges into the cylindrical wall (2) of the housing (1) to define an annular oil reservoir (14) between the cylindrical wall (2) and the cylindrical guide sleeve (6,28), the oil reservoir being supplied with oil through a bore (15) leading to the outside of the housing, a self-adjusting hydraulic play compensating element (13) guided in the guide sleeve for slidable longitudinal movement and comprising an inner piston (17) and an outer piston (16) surrounding said inner piston, both pistons being guided for slidable longitudinal movement within each other to define an oil pressure chamber (23), which through a bore (21) closed by a check valve (22) in the inner piston (17) is connected to a centric oil reservoir (18) arranged in the inner piston (17), and defined, on the one hand, by the wall of the inner piston (17) and, on the other hand, by the inner surface (10) of the end member (3), against which the inner piston (17) abuts with its end face, the outer piston (16) being guided for slidable longitudinal movement in the cylindrical guide sleeve (6,28) with its closed end abutting against the end of the valve stem.

Through this construction, the transfer of oil from the outer annular oil reservoir to the concentric oil reservoir no longer takes place at a point turned to the bottom, i.e., at a point at which the air present in the outer oil reservoir would settle, but rather at a point distant from the bottom. In this manner, it is ensured with great certainty that air present in the outer annular oil reservoir cannot be sucked into the concentric oil reservoir. The provision of the intake-port should preferably be in the vicinity of the end of the guide sleeve away from the bottom so that it should be arranged as distant as possible from the bottom-side end of the guide sleeve. It is understood that this does not mean that it has to be arranged at the opposite end of the guide sleeve. Rather, a marked improvement of the conditions is already obtained when this intake-port is arranged, for example, in the center of the longitudinal extension of the guide sleeve.

Figure 2:
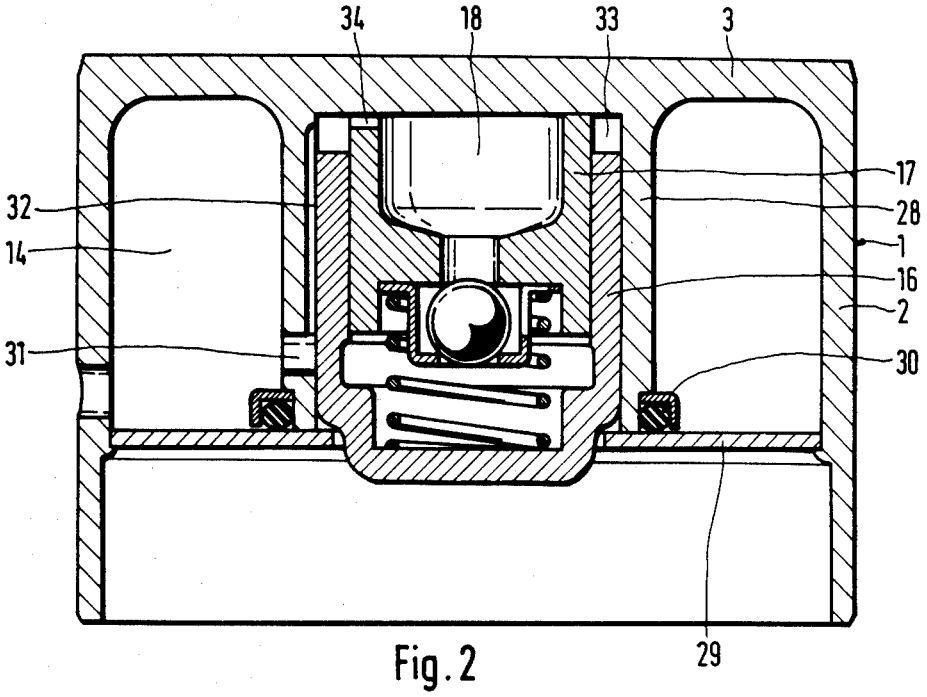
Figure 3:
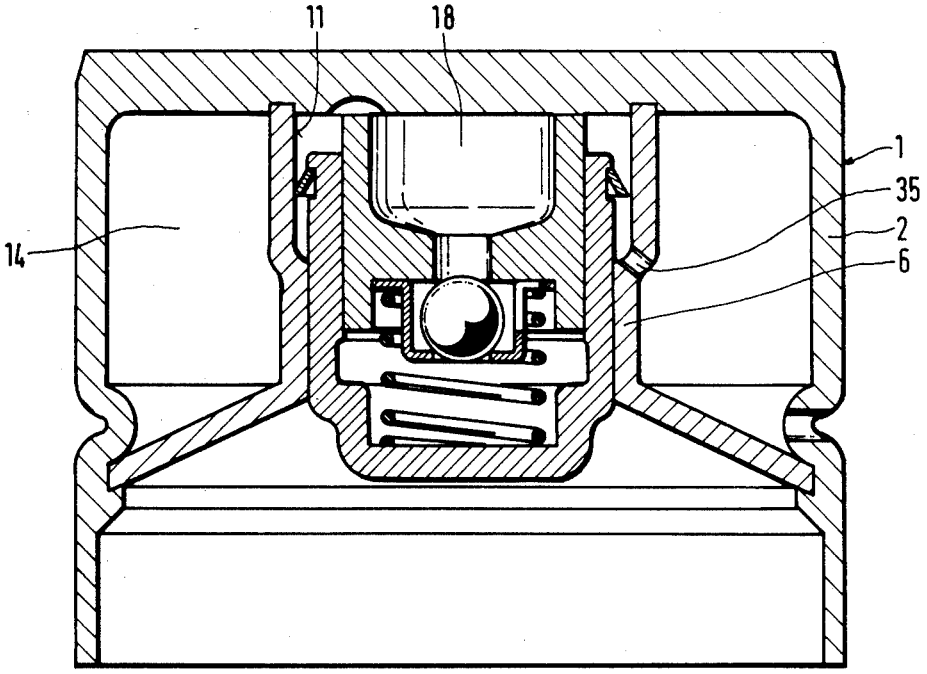

Referring now to the drawings:

FIGS. 1 to 3 illustrate three different longitudinal cross-sections of tappet embodiments of the invention.

The tappet shown in FIG. 1 is comprised of cup-shaped housing 1 which consists of a hollow cylindrical wall 2 closed at one end by end member 3. In this housing, an inner element 4 formed by an annular flange element 5 and a cylindrical guide sleeve 6 is arranged. At contact point 7 between the outer periphery of flange element 5 and the hollow cylindrical wall 2, these two parts are firmly joined together. To obtain a joint impervious to liquids, additional soldering, welding or similar can be effected at this spot. For the purpose of the joint, the flange element 5 is braced against peripheral groove 9 formed in the hollow cylindrical wall 2 and is covered on the other side by the bead 8 formed out of the hollow cylindrical wall.

The cylindrical guide sleeve 6 engages at its front end a groove in the inner surface 10 of end member 3 and in this end area, the guide sleeve 6 has an enlarged inside diameter 11 to provide space for a disc washer 12, with which the hydraulic play compensating unit 13 is secured against sliding out of the bore of guide sleeve 6.

The annular cavity defined by the hollow cylindrical wall 2, the flange element 5, the cylindrical guide sleeve 6 and the inner surface 10 of end member 3 forms an annular oil reservoir 14 which can be supplied with oil from the outside through the bore 15 arranged in the peripheral groove 8. The hydraulic play compensating unit 13 is comprised of outer piston 16 which is slideably arranged in the guide sleeve 6 which in turn slideably receives inner piston 17 with very little play. The piston 17 has at its end facing the end member 3 a centric oil reservoir 18 which by means of recess 19 in the inner surface 10 of end member 3 is in liquid connection with the annular chamber 20 between inner piston 17 and guide sleeve 6. From the centric oil reservoir 18, the oil can pass through bore 21 which can be closed by check valve 22 into the high pressure oil chamber 23 which is defined by pistons 16 and 17. These two pistons are pressed apart under the action of spring 24. The lower end plane 25 of outer piston 16 is in contact with the end plane of the stem of the engine valve when in the mounted state, while a control cam abuts against the outside of end member 3.

The oil from the outer annular oil reservoir 11 thus reaches the longitudinal groove 27 through intake port 26 and from there passes into annular chamber 20 and through recess 19 into centric oil reservoir 18. Any air possibly settling in outer oil reservoir 14 at the top end thus cannot get into the centric oil reservoir 18.

The tappet embodiment shown in FIG. 2 differs from that of FIG. 1 essentially by the different design of the outer cup-shaped housing 1. The guide sleeve 28 is formed in one piece with end member 3, and the outer oil reservoir 14 is closed off at its end away from end member 3 by a separate disc element 29 which at its outer edge is wedged into the bore of the hollow cylindrical wall 2 and which is sealed against the end of guide sleeve 28 by an O-ring 30 inserted in the latter.

Here, too, the transfer of oil from annular oil reservoir 14 to centric oil reservoir 18 is effected by an intake port 31 provided in guide sleeve 28 at its end away from the end member 3, which intake port ends in the longitudinal groove 32 provided in the bore of guide sleeve 28. Through this longitudinal groove, the oil reaches annular chamber 33 between inner piston 17 and guide sleeve 28, and from there, passes through a recess 34 provided at the front end of inner piston 17 and finally gets to the centric oil reservoir 18.

The tappet embodiment represented in FIG. 3 differs from that acoording to FIG. 1 in that the area of guide sleeve 6 which has the englarged inside diameter 11 is extended and that the intake port 35 is situated at the end of this zone that is away from the end member 3. In this manner, the arrangement of an additional longitudinal groove in the bore of guide sleeve 6 can be dispensed with. Although intake port 35 is not as far away from end member 3 as in the embodiments of FIGS. 1 and 2, it will still be able to perform fully its assignment in the majority of cases, because outer oil reservoir 14 will, as rule, not contain so much air that the air will reach into the area of intake port 35.

In the embodiments according to FIGS. 1 and 3, care must be taken through appropriate measures (e.g., soldering, gluing or similar) that a transfer of air from the oil reservor 14 into the annular chamber 20 is assuredly prevented.

Various modifications of the apparatus of the invention may be made without departing from the spirit or scope thereof and it should be understood that the invention is intended to be limited only as defined in the appended claims.

What I claim is:

1. A self-adjusting hydraulic valve tappet arranged in a guide bore of a cylinder head of an internal combustion engine and contacted at one end face by a control cam and abutting with a second end face against the end of a valve stem, the tappet consisting of a cup-shaped housing (1) comprising a hollow cylindrical wall (2) closed at one end by an end member (3) against the outside of which the cam abuts, and a cylindrical guide sleeve (6,28) concentric with the cylindrical wall (2), said guide sleeve emanating from the end member (3) extends to the center of an annular flange element (5,29), which at its outer circumference merges into the cylindrical wall (2) of the housing (1) to define an annular oil reservoir (14) between the cylindrical wall (2) and the cylindrical guide sleeve (6,28), the oil reservoir being supplied with oil through a bore (15) leading to the outside of the housing, a self-adjusting hydraulic play compensating element (13) guided in the guide sleeve for slidable longitudinal movement and comprising an inner piston (17) and an outer piston (16) surrounding said inner piston, both pistons being guided for slidable longitudinal movement within each other to define an oil pressure chamber (23), which through a bore (21) closed by a check valve (22) in the inner piston (17) is connected to a centric oil reservoir (18) arranged in the inner piston (17), and defined, on the one hand, by the wall of the inner piston (17) and, on the other hand, by the inner surface (10) of the end member (3), against which the inner piston (17) abuts with its end face, the outer piston (16) being guided for slidable longitudinal movement in the cylindrical guide sleeve (6,28) with its closed end abutting against the end of the valve stem, characterized in that the guide sleeve has at a point distant from the end member (3) an intake port (26,31,53) that opens into a duct extending to the end member (3), which is defined, on the one hand, by the outer surface of the outer piston (16) and, on the other hand, by the bore of the guide sleeve (6), and an oil transfer port (19,34) leading into the centric oil reservoir (18) is provided at the end of the inner piston (17) facing the end member (3).

2. A valve tappet of claim 1 wherein the duct is formed by a longitudinal groove (27,32) provided in the wall of the bore of the guide sleeve (6,28).

3. A valve tappet of claim 1 wherein the duct is formed by an enlargement of the inside diameter (11) of the guide sleeve (6).

4. A valve tappet of claim 1 wherein the oil intake-port into the centric oil reservoir (18) is formed by a recess (19) in the end member (3) overlapping the contact surface between inner piston (17) and inner surface (10) of the end member (3).

5. A valve tappet of claim 1 wherein the oil intake port into the centric oil reservoir (18) is formed by at least one recess (34) at the front end of the inner piston (17).

* * * * *